US006056439A

United States Patent [19]

Graham

[11] Patent Number: 6,056,439

[45] Date of Patent: May 2, 2000

[54] HIGH FLOW/VOLUME VALVE FOR FLEXIBLE PACKAGING

[75] Inventor: Paul H. Graham, Lansdale, Pa.

[73] Assignee: Fres-co System USA, Inc., Telford, Pa.

[21] Appl. No.: 09/238,556

[22] Filed: Jan. 28, 1999

[51] Int. Cl.[7] ..... B65D 33/01

[52] U.S. Cl. ..... 383/103; 220/89.1

[58] Field of Search ..... 383/100, 103; 220/89.1; 206/524.8; 137/246, 493, 533

[56] References Cited

U.S. PATENT DOCUMENTS

| | | | |
|---|---|---|---|
| 2,638,263 | 5/1953 | Jesnig | 383/103 |
| 3,595,467 | 7/1971 | Goglio . | |
| 3,799,427 | 3/1974 | Goglio . | |
| 4,365,715 | 12/1982 | Egli | 206/524.8 |
| 4,420,015 | 12/1983 | Blaser . | |
| 4,444,219 | 4/1984 | Hollenstein . | |
| 4,690,667 | 9/1987 | Domke | 383/103 X |
| 5,354,133 | 10/1994 | Rapparini | 383/103 |
| 5,584,409 | 12/1996 | Chemberlen | 383/103 X |
| 5,893,461 | 4/1999 | Walters | 220/89.1 X |

*Primary Examiner*—Jes F. Pascua

*Attorney, Agent, or Firm*—Caesar, Rivise, Bernstein, Cohen & Pokotilow, Ltd.

[57] ABSTRACT

A package including a degassing valve for holding a material, e.g., a particulate material, within the package isolated from the ambient atmosphere. The degassing valve is mounted on the wall panel and basically comprises a cap, a base, and a flexible disk. The cap is a hollow cylindrical member from which three peripheral portions are cut away to form three equidistantly spaced peripheral outlet ports disposed above an uninterrupted ring-like portion of the cap. The base is a generally cup-shaped member having first portion arranged to be located and snap-fit within the cap member and which forms a valve seat. An inlet port extends to the valve. The disk is located on the valve seat and covering the inlet port but is movable with respect thereto. The inlet port of the valve is in communication with the interior of the package and the peripheral outlet ports are in communication with the ambient atmosphere, whereupon gas within the package is enabled to flow through the inlet port, under the disk member to cause at least a portion of the disk member to move off of the valve seat, and out through the outlet port to the ambient atmosphere. The disk may include at least one aperture so that the degassing valve is of the two-way type, instead of a one-way type.

38 Claims, 5 Drawing Sheets

HIGH FLOW/VOLUME VALVE FOR FLEXIBLE PACKAGING

BACKGROUND OF THE INVENTION

This invention relates to valves and more particularly to degassing valves for use in flexible packaging.

Packages made out of flexible material are commonly used to store products to isolate the products from the ambient atmosphere. Those products may be agricultural products, foodstuffs, chemicals, etc. Typically, the flexible packages are of either a gussetted type or a "pillow" type. The gussetted type package or bag basically comprises a front and rear panel connected to each other along their respective marginal edges by gussetted side panels. The pillow or pouch-type flexible package merely consists of a front and rear panel connected to each other directly. In either case the package may be formed into a tube from a single sheet or web and then welded or otherwise seamed to complete the package.

It is a common practice to include in various types of flexible packages, whether a gussetted or pouch-type, a valve to enable air which may be trapped within the bag or gases produced by the contents of the bag to exit the bag through the valve while precluding the ambient atmosphere, e.g., air, from entering into the bag through the valve. Examples of such degassing valves are those sold by Pacific Plus, Inc., of Bellevue, Wash. SIG-Schweizerische Industrie-Besellschaft, of Heuhausen am Rheinfall, Switzerland, also sells such valves (e.g., the valve disclosed in U.S. Pat. No. 4,420,015). Wipf AG Verpackungen, of Volketswil, Switzerland, also sells such valves (e.g., the valve disclosed in U.S. Pat. No. 4,444,219). Luigi Goglio Milano, SPA, of Milan, Italy also sells such valves (e.g., the valve disclosed in U.S. Pat. No. 3,799,427, as well as other valves).

For packaging applications wherein the package is expected to be stacked on other like packages, such as on a pallet, it is of considerable importance that any entrained or entrapped air or other gases be quickly exhausted through the valve as the packages are stacked one on another to provide stability to the stack of packages. Absent the rapid egress of air or gas from the package, the stack of packages could be unstable due to air entrapped or entrained in the packages of the stack.

While the aforementioned valves of the prior art are generally suitable for their intended purposes to vent entrapped gas or air from the flexible package, they still suffer from one or more disadvantages.

For example, the heretofore identified valve sold by Pacific Plus, Inc. basically comprises a two-piece assembly in the form of a base portion in the form of a cap-like member having a rubber disk or valve member in it. The cap includes three arcuate gas exit slots which are disposed in a circular array in the center portion of the base member. A circular valve disk, such as made of neoprene or some other rubber, is disposed within the base member and over the three arcuate outlet ports. The valve is designed to flex to enable gas to flow around it and out through the exit ports when the pressure within the package exceeds the ambient pressure. The rubber disk member is held in place by three inwardly extending ears projecting inward from the base or cap member. The mounting arrangement of the disk, i.e., being held in place by the three inwardly extending ears, renders this valve susceptible to the disk popping out of place when gas vents out the valve. Such action thus renders the valve inoperative.

The heretofore identified SIG valve basically comprises a three-piece member, that is, a cup-shaped member having a central opening or port, a very thin flexible plastic disk or diaphragm, and an insert or clamping member of generally rectangular shape but having arcuate opposed ends arranged to be snap fit into the cap-shaped member to hold the flexible valve member between it and the outlet port. Gases are enabled to flow through the space between the linear sides of the clamping member and the arcuate portion of the cap under the polyester valve disk or diaphragm and out through the central opening when the pressure within the interior of the flexible package exceeds that of the ambient atmosphere. This valve is susceptible to becoming clogged or otherwise rendered inoperative in the event that the bag contains fine particulate materials which would gain ingress into the interior of the valve.

The heretofore identified Wipf valve basically comprises a three-piece member, that to is, a cup-shaped valve body having a plural holes or port, a very thin flexible plastic disk or diaphragm, and an insert or keeper of generally I-shape fit in the cap-shaped member to hold the flexible diaphragm between it and the ports. Gases are enabled to flow through the space between the sides of keeper and the arcuate portion of the cap under the diaphragm and out through the plural ports when the pressure within the interior of the flexible package exceeds that of the ambient atmosphere. This valve, like the SIG valve, is susceptible to becoming clogged or otherwise rendered inoperative in the event that the bag contains fine particulate materials which would gain ingress into the interior of the valve.

The degassing valve of Pacific Plus, Inc. also suffers from the same susceptibility to clogging or inoperative action as the SIG and Wipf valves.

SUMMARY OF THE INVENTION

A degassing valve for a package, e.g., a flexible package, and a package including a degassing valve. The package has at least one wall defining a hollow interior for holding a material, e.g., a granular or particulate product, therein. The degassing valve is arranged to be mounted on the wall and basically comprises a cap member, a base member, and a flexible disk. The cap member is a generally cylindrical hollow member having a circular top wall and a generally circular side wall. The disk member is a generally planar member having a generally circular profile and is located within the cap member. At least one portion of the top wall and at least one portion of said side wall of the cap member is cut-away to form at least one peripheral opening. The base member is a generally cup-shaped member having first portion arranged to be located and secured within the cap member. The first portion of the cup shaped member forms a valve seat and has an inlet port in fluid communication therewith. The disk member is located on the valve seat and covers the inlet port, but is movable away from the valve seat to allow gas from within the package to escape to the ambient atmosphere.

The degassing valve is arranged to be mounted on the wall panel of the package, so that the inlet port of the valve is in fluid communication with the interior of the package and with the at least one peripheral opening in the cap member being in communication with the ambient atmosphere. Thus, gas within the package is enabled to flow through the inlet port, under the disk member to cause at least a portion of the disk member to move off of the valve seat, and out through the at least one peripheral port to the ambient atmosphere.

DESCRIPTION OF THE PREFERRED EMBODIMENT

Figure 1:
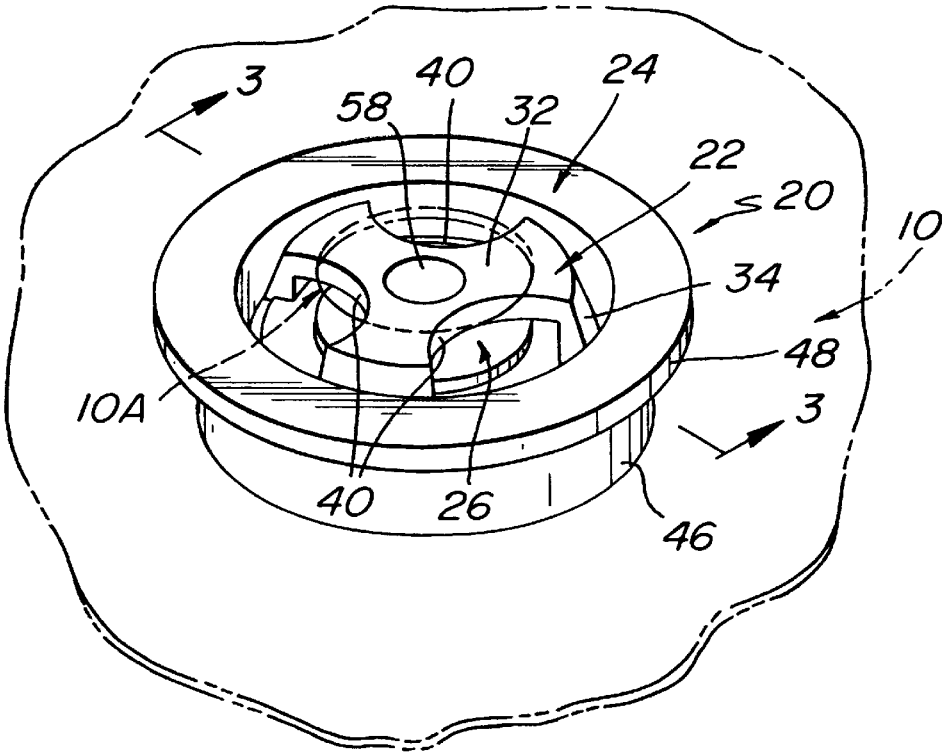
FIG. 1 is an isometric view of one embodiment of a one-way, degassing valve constructed in accordance with this invention shown mounted on the wall or panel of a conventional flexible package.
Figure 5:
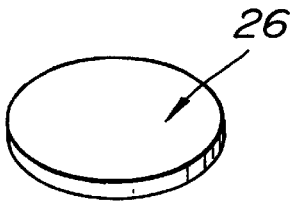
FIG. 5 is an isometric view of a valve disk member forming a portion of the valve of FIG. 1.

Referring now to the various figures of the drawing wherein like reference characters refer to like parts, there is shown at 20 in FIG. 1 one embodiment of degassing valve constructed in accordance with one embodiment of this invention for use in any type of flexible package or bag 10. The valve is arranged to allow the venting of gas within the interior of the package to the ambient atmosphere, while precluding ingress of the ambient atmosphere into the package. The package 10, while preferably formed of a flexible packaging material may be a rigid or self-supporting type of packaging material. In any case, one particular use for the package is for holding a particulate material product in it under hermetically sealed conditions.

Figure 2:
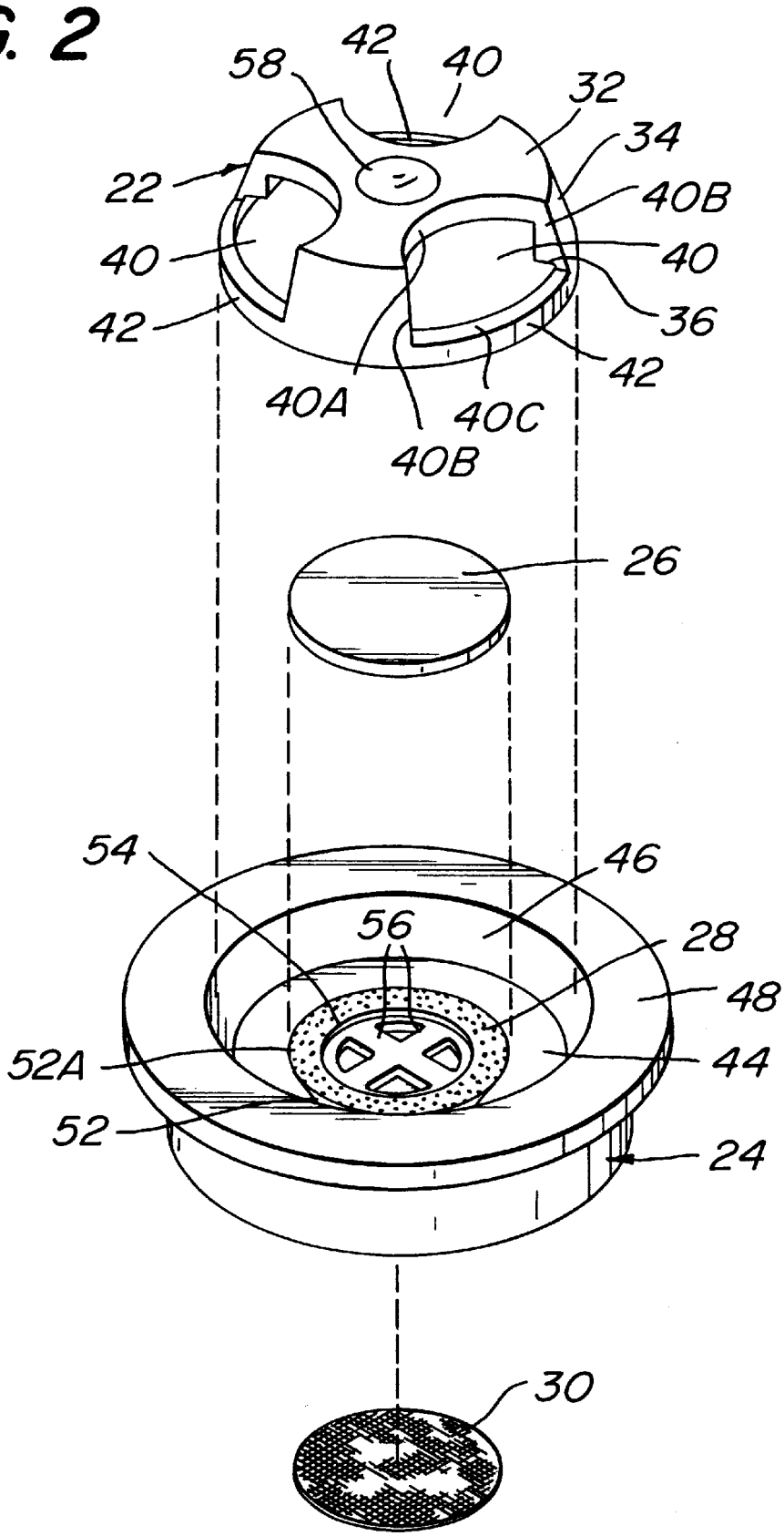
FIG. 2 is an exploded isometric view of the valve shown in FIG. 1.
Figure 3:
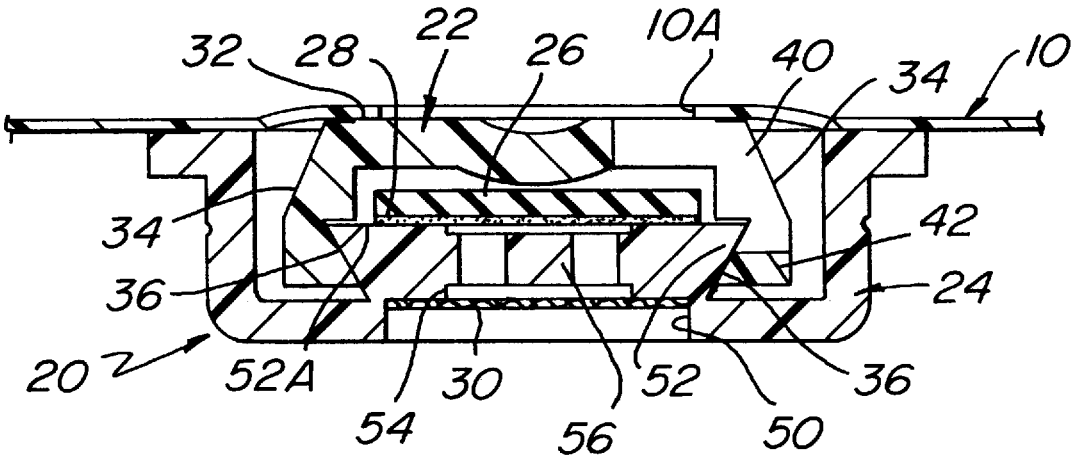
FIG. 3 is an enlarged sectional view taken along line 3—3 of FIG. 1 and showing the degassing valve of the package in its normally closed condition precluding the ingress of ambient air into the package.
Figure 4:
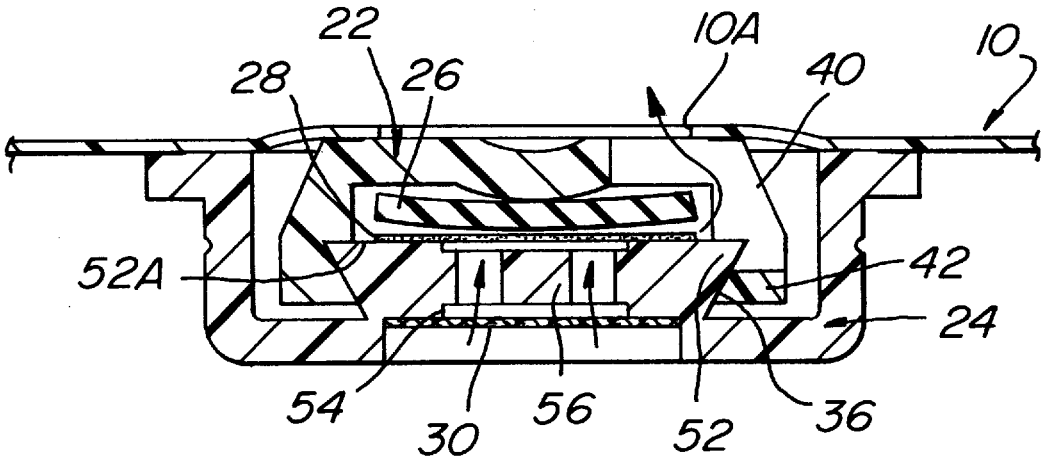
FIG. 4 is a view similar to FIG. 3, but showing the valve venting gas out of the package to the ambient atmosphere.

Referring now to FIGS. 1–4, the degassing valve 20 can be seen to basically comprise a cap member 22, a base 24, a flexible and elastomeric, e.g., rubber, disk 26, a thin layer of a viscous material, e.g., silicone oil 28 (FIGS. 2, 3 and 4), and a filter disk 30 (FIGS. 2, 3 and 4). Preferably the valve 20 is constructed somewhat like that of the aforementioned U.S. Pat. No. 3,799,427 (Goglio), or of another Goglio patent, namely, U.S. Pat. No. 3,595,467. The disclosures of both of those Goglio patents are specifically incorporated by reference herein.

As can be seen the cap member 22 is a generally cylindrical member having a generally planar top wall 32 and a slightly conical side wall 34 terminating at its bottom in an under-cut groove 36. Portions of the top wall 32 and the contiguous sidewall 34 of the cap member are cut-away to form plural outlet ports 40 for the valve. The outlet ports are equidistantly spaced about the periphery of the cap member. The number of outlet ports utilized and their shape, as shown herein, is merely exemplary. Thus, any number of outlet ports of any shape can be utilized, depending upon the flow characteristics desired for the valve. In the exemplary embodiment shown and described herein, there are three such outlet ports.

As best seen in FIG. 2, each outlet port 40 extends partially into the top wall 32 and partially into the contiguous sidewall 34 of the cap member, but does not extend the entire height of the sidewall. Thus, the bottom of the cap member is in the form of an uninterrupted ring 42. This ring provides a disk-retaining function (to be described later).

In the exemplary embodiment shown, each of the outlet ports is defined by a circular arc segment 40A edge in the top wall 32 of the cap member, by two generally linear side vertical edges 40B extending downward into the sidewall 34 from opposite sides of the arc segment 40A, and by a generally linear horizontal edge 40C located close to the bottom edge of the sidewall of the cap member between the side edges 40B. As will be described in detail later, the retaining ring 42 serves to hold the valve member or disk 26 in position within the valve so that it may operate properly over extended periods of time.

The base member 24 is a generally cup-shaped member having a planar circular bottom wall 44 and a circular sidewall 46 terminating at its top in an annular flange 48. The bottom wall 44 includes a central opening or hole 50 (FIG. 3) having an annular flange 52 extending thereabout and projecting up from the interior surface of the bottom wall. The annular flange 52 is under-cut on its exterior surface to be received in e.g., be snapped-fit, and mate with the under-cut groove 36 in the cap member 22. The upper surface 52A of the flange 52 forms the "valve seat." An inlet port, central opening or hole 54 is provided in the flange 52 and is smaller than the hole 50 to form a ledge on which the filter disk 30 is disposed and secured, e.g., glued or heat sealed in place. A pair of cruciate arms 56 extend within the hole 54 to help support the filter disk.

The top wall 32 of the cap member includes a dimple 58 extending slightly downward. This dimple serves as a "disk contact point" to space and hold the disk member 26 on the "valve seat."

The outlet ports 40 and the cap member serve as the means to enable gas from the interior of the package 10 to exit through the valve to the ambient atmosphere. This is accomplished via a vent hole 10A (shown in phantom lines in FIG. 1 and by solid lines in FIGS. 3, 4, 6, 7 and 8) provided in the package's front wall or panel. As best seen in FIGS. 3 and 4, the outer surface of the base 24 member of the valve is welded to the inner surface of the package's front wall panel about a distance from the periphery of the hole 10A. Thus, portions of the three outlet ports 40 of the cap member 22 are encompassed within the bounds of the periphery of the vent hole 10A and hence are in free fluid communication with the ambient atmosphere through that vent hole, whereupon gases within the package can vent out the valve through the ports 40 as shown by the arrow in FIG. 4. Note that while the gas can only be seen venting through one port 40 in the sectional view of FIG. 4, the gas can vent through each of the three ports 40 in the same manner as that shown.

Since there are three relatively large, e.g., 3/16" diameter, outlet ports, a substantial volume of gas, e.g., air, is enabled to flow at a substantial flow rate out through the valve. Thus, the interior of the package can be degassed very quickly using the valve of this invention.

The valve disk 26 is planar circular member which is disposed on the top surface or valve seat 52A of the annular flange 52 so that it is disposed over the central opening 50 in the base member 24. A thin layer of silicone oil 28 is interposed between the disk member 26 and the valve seat 52A.

The cap member 22 is arranged to be snap fit on the base member 24 to form a hollow interior chamber, with the disk member 26 and the oil layer being disposed therein.

The retaining ring portion 42 of the cap member 22 ensures that the disk member 26 cannot move laterally off the valve seat 52A. In addition, the retaining ring, being uninterrupted, ensures that the cap member and the base member when snap-fit together, do not become separated as could occur if the bottom of the cap member could separate if the ports 40 extended to the bottom edge of the cap member.

In accordance with the preferred embodiment of this invention, the cap member 22 and the base member 24 are each injection molded of polyethylene. The disk member 26 is stamped from a sheet of polyisobutylene rubber. The filter disk is a circular sheet of non-woven, heat-sealable filter paper.

The elastic nature of the rubber valve disk 26 enables it to flex during operation of the valve 20. In particular, when the pressure within the package 10 exceeds the pressure outside of the package, i.e., the ambient atmosphere, the disk 26 flexes off of the valve seat 52A to create a gap through which gas from the interior of the package can pass to the ambient atmosphere, such is shown by the arrows in FIG. 4. As mentioned earlier, since there are three relatively large, e.g., 3/16" diameter, outlet ports 40, a substantial volume of gas, e.g., air, from within the package 10 is enabled to flow at a substantial flow rate through the valve to the ambient atmosphere. Thus, the interior of the package 10 can be degassed very quickly.

The elastic nature of the rubber valve disk 26 also serves to effect the automatic reclosure of the valve 20 when the pressure within the package 10 drops to that of the ambient atmosphere outside the package, whereupon the disk 26 assumes its unflexed, flat configuration in engagement with the valve seat 52A, as shown in FIG. 3. Moreover, the viscous nature of the silicone oil at the interface of the valve disk 26 and valve seat 52A creates a seal between the valve disk and the valve seat which is impermeable to atmospheric gases, e.g., oxygen, moisture and odors.

The filter disk 30 is disposed within the base member of the valve so that it covers the hole 54 in the base member in order to protect the valve disk 22 and contiguous valve seat from being contaminated or otherwise rendered inoperative by the ingress particles of any particulate material held within the package 10.

If desired, the degassing valve used in the package of this invention may be constructed in accordance with the teachings of co-pending U.S. patent application Ser. No. 08/826,700, filed on Apr. 7, 1997, and U.S. patent application Ser. No. 09/134,301, filed on Aug. 14, 1998, both entitled PRESSURE VACUUM RELEASE HERMETIC VALVE FOR FLEXIBLE PACKAGE, which are assigned to the same assignee as this invention, and whose entire disclosures are incorporated by reference herein. The valves of those two patent applications can be called "two-way valves" or "pressure equalizing valves" and are particularly useful for packages wherein a use of a convention-one way degassing valve, like valve 20 discussed above (or other valves disclosed in this application), may result in the creation of an undesirable pebbly or unsmooth appearance of the walls of the package when the package is filled, evacuated and hermetically sealed.

The two-way valves of the aforementioned co-pending applications are similar to the one-way degassing valve 20 disclosed herein, except for the inclusion of at least one aperture in the rubber valve disk member 26 to enable the valve to allow some ambient air to enter the package so that the package's walls provide a smooth aesthetically pleasing appearance.

In FIG. 6–8 and 10, there is shown a two-way degassing valve 200 constructed in accordance with the teachings of this application and utilizing the teachings of the two aforementioned co-pending patent applications. In particular, the valve 200 is constructed similar to valve 20 except for the inclusion of at least one slit or aperture in the valve's disk (to be described later), and the omission of the cruciate filter paper supporting arms in the bore of the base member of the valve. Thus, in the interest of brevity, the common components of the valve 200 and the valve 20 will be given the same reference numbers and the details of their construction and operation will not be reiterated.

Figure 11:
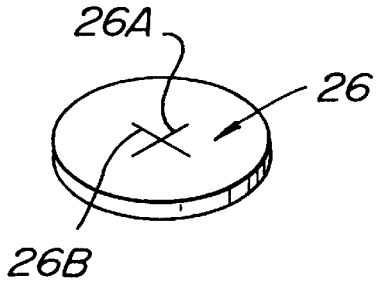
FIG. 11 is an isometric view of the valve disk member forming a portion of the valve of FIG. 6.
Figure 8:
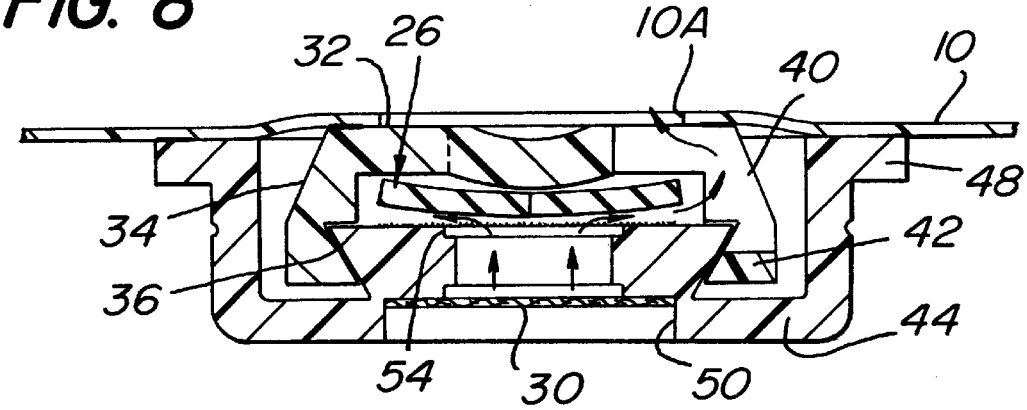
FIG. 8 is a sectional view, similar to FIGS. 6 and 7, but showing the valve of FIG. 6 in a third mode of operation allowing gas within the interior of the package to pass through the valve to the ambient atmosphere, while precluding the ingress of ambient air into the package.
Figure 9:
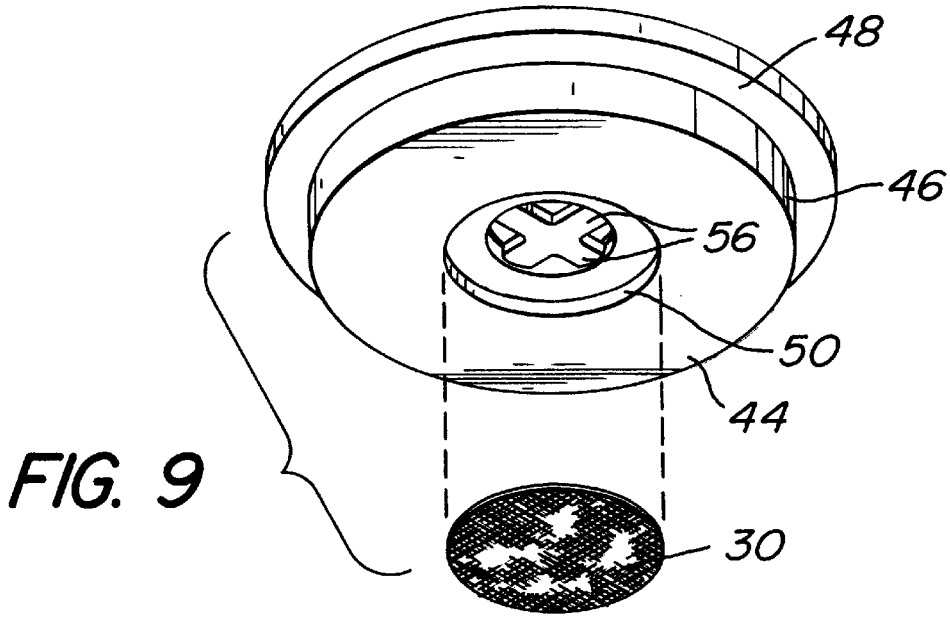
FIG. 9 is an exploded isometric view of a portion of the valve shown in FIG. 1.
Figure 10:
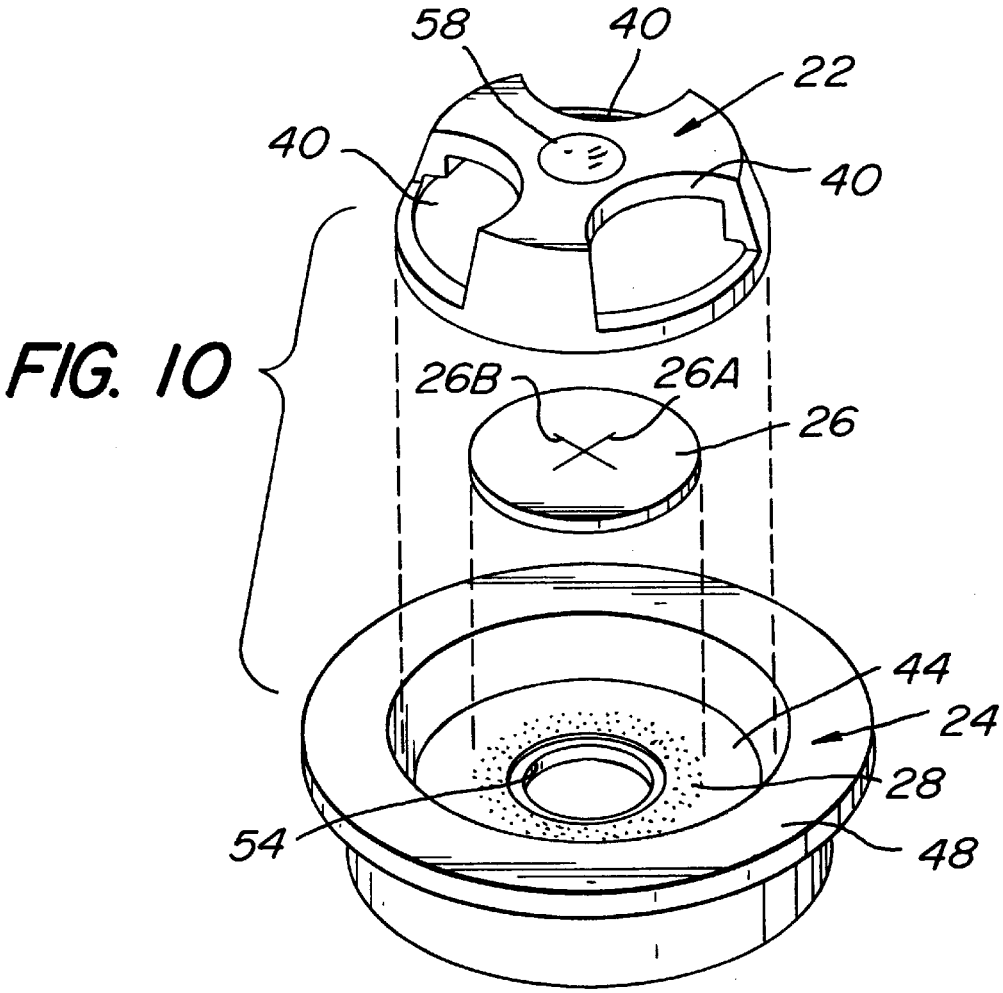
FIG. 10 is an exploded isometric view of a portion of the valve shown in FIG. 6.

As can be seen in FIG. 11, the valve disk 26 includes a pair of intersecting slits or apertures 26A and 26B. The inclusion of these slits or apertures results in a pressure-equalizing valve which is arranged to operate in a first mode of operation, such as shown in FIG. 8, wherein any gases within the package are allowed to vent to the exterior of the package as shown by the arrows in that figure. In this mode of operation, the ambient atmosphere is precluded from entering into the interior of the package due to the escaping gases.

Figure 6:
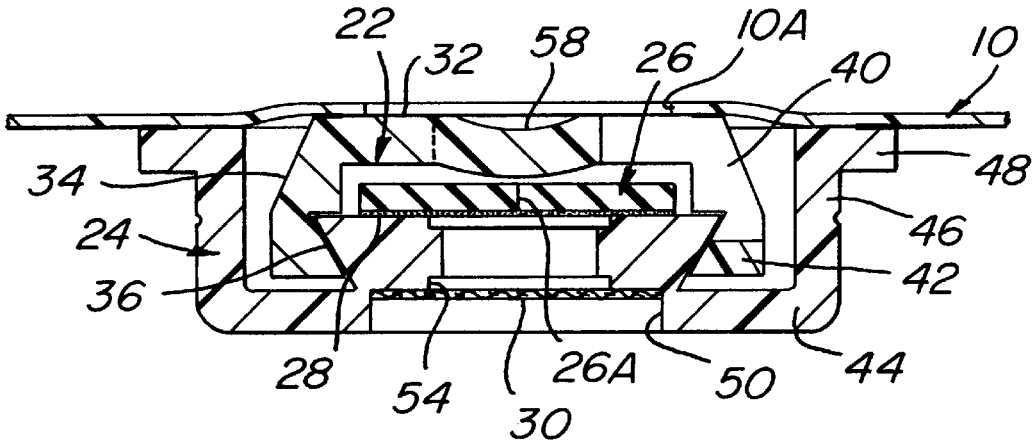
FIG. 6 is a sectional view, similar to FIG. 3, of an alternative embodiment of a valve constructed in accordance with this invention, the valve being a two-way degassing and pressure equalizing valve shown in one mode of operation wherein it is closed to preclude the ingress of ambient air into the package.
Figure 7:
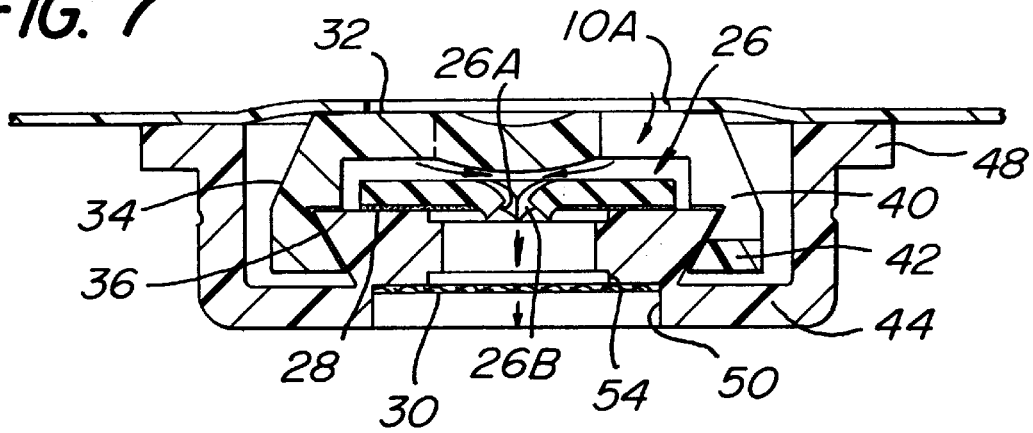
FIG. 7 is a sectional view, similar to FIG. 6, but showing the valve of FIG. 6 in a second mode of operation allowing some ambient air to enter into the package until the pressure within the package equals the pressure outside the package.

The valve 200 is also capable of operating in a second, transitory, mode of operation, which is shown in FIG. 7. In this mode of operation, the valve 200 allows a small amount of the ambient atmosphere to gain ingress through the slits 26A and 26B in the valve disk into the interior of the package as shown by the arrows in that figure. This small amount of air able to gain ingress into the package enables the package's walls to move out of intimate engagement with the particulate materials therein and thus the walls smooth out to provide a smooth visually attractive appearance. Once the pressure has equalized within the valve, i.e., the pressure within the valve is equal to the pressure of the ambient atmosphere, the valve 200 then enters into its third mode of operation, as shown in FIG. 6. In this mode, the valve isolates the interior of the package from the ambient atmosphere, so that further ingress of air through the slits in the valve disk is precluded.

As explained in the foregoing patent applications, two mechanisms are relied upon for the two-way pressure equalizing valve to operate. In particular, the elastic nature of the rubber disk enables the area portions of the disk between adjacent or contiguous slits 26A and 26B to flex independently of other portions of the disk between or adjacent other contiguous slits. Moreover, when the rubber disk is flexed during operation of the valve, a gap is created at the interface of the slits and through which the outside air can pass. In order to insure there is no impediment to the spreading and flexure of the portions of the disk contiguous with the slits when the valve is in its second mode of operation, the cruciate arms 56 which were used in the bore of the base member 20 to support the filter disk 30 may be eliminated. Thus, the portions of the valve disk 26 contiguous with the slits can flex freely downward into the bore 54 without impediment such as shown in FIG. 7.

The elastic nature of the rubber disk 26 also serves to effect the automatic reclosure of the slits 26A and 26B and to keep those slits closed and impermeable to oxygen, moisture and odors when the disk is unflexed and flat. As discussed with reference to valve 20, the viscous nature of the silicone oil used in the valve 200 also serves to create a seal between the rubber valve disk 26 and valve seat 54A which is impermeable to atmospheric gases, e.g., oxygen, moisture and odors.

As should be appreciated from the foregoing, the valve and the package including the valve as described above allows for increase in volume of gas flow or air flow through the valve from its interior to the ambient by reducing the restrictions on the cap. The foregoing advantages are achieved without substantial modifications to the cap over prior art similarly constructed caps. In particular, the modifications to the valve, e.g., the inclusion of one or more large peripheral outlet ports, is accomplished without requiring any modification to the size or shape of the various components of the valve.

Without further elaboration the foregoing will so fully illustrate my invention that others may, by applying current or future knowledge, adopt the same for use under various conditions of service.

I claim:

1. A degassing valve for a package having an interior for holding a material therein, the package having at least one wall panel bounding an interior in which the material is located, said degassing valve comprising a cap member, a base member, and a flexible disk member, said cap member being a generally cylindrical hollow member having a circular top wall and a generally circular side wall, said disk member being a generally planar member having a generally circular profile and being located within said cap member, at least one portion of said top wall and at least one portion of said side wall of said cap member being cut-away to form at least one peripheral opening, said base member being a generally cup-shaped member having first portion arranged to be located and secured within said cap member, said first portion of said cup-shaped member forming a valve seat having an inlet port therein, said disk member being located on said valve seat and covering said inlet port but being movable with respect thereto, said degassing valve being arranged to be mounted on the wall panel of the package, with said inlet port of said valve being in communication with the interior of the package and with said at least one peripheral opening being in communication with the ambient atmosphere, whereupon gas within the package is enabled to flow through said inlet port, under said disk member to cause at least a portion of said disk member to move off of said valve seat, and out through said at least one peripheral port to the ambient atmosphere.

2. The valve of claim 1 wherein said cap member includes an uninterrupted circular peripheral portion extending about the periphery of said disk member to restrain said disk member from moving laterally.

3. The valve of claim 1 wherein said cap member includes three peripheral ports, located equidistantly about the periphery of the side wall of said cap member.

4. The valve of claim 3 wherein each of said peripheral ports is of arcuate shape at said top wall of said cap-member.

5. The valve of claim 1 wherein said valve is a one-way valve.

6. The valve of claim 1 wherein said valve is a two-way valve.

7. The valve of claim 6 wherein said disk member has at least one aperture therein.

8. The valve of claim 5 additionally comprising a viscous material located between said disk and said valve seat.

9. The valve of claim 8 wherein said viscous material comprises oil.

10. The valve of claim 6 additionally comprising a viscous material located between said disk and said valve seat.

11. The valve of claim 10 wherein said viscous material comprises oil.

12. The valve of claim 1 additionally comprising a filter located over said inlet port to prevent the ingress of material into said valve.

13. The valve of claim 1 wherein said base member comprises a peripheral flange, said cap member being secured to the wall panel of the package along said peripheral flange.

14. The valve of claim 8 wherein the wall panel of the package includes an inner surface and a hole, the hole in the wall panel being in communication with the ambient atmosphere, and wherein said peripheral flange of said base member is secured to the inner surface of the wall panel aligned with the opening therein.

15. The valve of claim 1 additionally comprising a portion of said top wall of said cap member extending downward to engage a portion of said disk member to hold said disk member in position on said valve seat.

16. The valve of claim 1 wherein said cap member and said base member are arranged to be snap fit together.

17. The valve of claim 16 wherein said cap member includes a peripheral recess, and wherein said first portion of said cup shaped member includes a peripheral flange arranged to be snap-fit into said peripheral recess in said cap member.

18. The valve of claim 1 wherein said cap member and said base member are each formed of a plastic material.

19. The valve of claim 1 wherein said disk member is formed of a resilient material.

20. A package having an interior for holding a material therein, said package having at least one wall panel bounding an interior in which the material is located and a degassing valve mounted on said at least one wall panel, said degassing valve comprising a cap member, a base member, and a flexible disk member, said cap member being a generally cylindrical hollow member having a circular top wall and a generally circular side wall, said disk member being a generally planar member having a generally circular profile and being located within said cap member, at least one portion of said top wall and at least one portion of said side wall of said cap member being cut-away to form at least one peripheral opening, said base member being a generally cup-shaped member having first portion arranged to be located and secured within said cap member, said first portion of said cup shaped member forming a valve seat having an inlet port therein, said disk member being located on said valve seat and covering said inlet port but being movable with respect thereto, said valve being arranged to be mounted on said at least one wall panel of said package, with said inlet port of said valve being in communication with said interior of said package and with said at least one peripheral opening being in communication with the ambient atmosphere, whereupon gas within said package is enabled to flow through said inlet port, under said disk member to cause at least a portion of said disk member to move off of said valve seat, and out through said at least one peripheral port to the ambient atmosphere.

21. The package of claim 20 wherein said cap member includes an uninterrupted circular peripheral portion extending about the periphery of said disk member to restrain said disk member from moving laterally.

22. The package of claim 20 wherein said cap member includes three peripheral ports, located equidistantly about the periphery of the side wall of said cap member.

23. The package of claim 22 wherein each of said peripheral ports is of arcuate shape at said top wall of said cap member.

24. The package of claim 20 wherein said valve is a one-way valve.

25. The package of claim 20 wherein said valve is a two-way valve.

26. The package of claim 25 wherein said disk member has at least one aperture therein.

27. The package of claim 24 additionally comprising a viscous material located between said disk and said valve seat.

28. The package of claim 27 wherein said viscous material comprises oil.

29. The package of claim 25 additionally comprising a viscous material located between said disk and said valve seat.

30. The package of claim 29 wherein said viscous material comprises oil.

31. The package of claim 20 additionally comprising a filter located over said inlet port to prevent the ingress of material into said valve.

32. The package of claim 20 wherein said base member comprises a peripheral flange, said base member being secured to said wall panel of said package along said peripheral flange.

33. The package of claim 32 wherein said wall panel of said package includes an inner surface and a hole, said hole in said wall panel being in communication with the ambient atmosphere, and wherein said peripheral flange of said base member is secured to said inner surface of said wall panel aligned with said opening therein.

34. The package of claim 20 additionally comprising a portion of said top wall of said cap member extending downward to engage a portion of said disk member to hold said disk member in position on said valve seat.

35. The package of claim 20 wherein said cap member and said base member are arranged to be snap fit together.

36. The package of claim 35 wherein said cap member includes a peripheral recess, and wherein said first portion of said cup shaped member includes a peripheral flange arranged to be snap-fit into said peripheral recess in said cap member.

37. The package of claim 20 wherein said cap member and said base member are each formed of a plastic material.

38. The package of claim 20 wherein said disk member is formed of a resilient material.

* * * * *